US012753523B2

(12) United States Patent
Nagy et al.

(10) Patent No.: US 12,753,523 B2
(45) Date of Patent: Oct. 6, 2026

(54) ELECTROCHEMICAL RECYCLING OF LITHIUM FROM LITHIUM-BASED MATERIALS

(71) Applicant: GM GLOBAL TECHNOLOGY OPERATIONS LLC, Detroit, MI (US)

(72) Inventors: Sayed Youssef Sayed Nagy, Troy, MI (US); Jeffrey David Cain, Royal Oak, MI (US); Nicholas Paul William Pieczonka, Windsor (CA); Thomas E. Moylan, Dearborn Heights, MI (US); Yuntao Gu, Farmington Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 586 days.

(21) Appl. No.: 18/087,410

(22) Filed: Dec. 22, 2022

(65) Prior Publication Data

US 2024/0218544 A1 Jul. 4, 2024

(51) Int. Cl.
*C25C 1/00* (2006.01)
*C25C 1/02* (2006.01)
*C25C 7/06* (2006.01)

(52) U.S. Cl.
CPC . *C25C 1/02* (2013.01); *C25C 7/06* (2013.01)

(58) Field of Classification Search
CPC ..... C25C 1/02; C25C 7/06
See application file for complete search history.

(56) References Cited

U.S. PATENT DOCUMENTS 8,859,144 B2 10/2014 Xiao
9,005,811 B2 4/2015 Xiao et al.
9,093,705 B2 7/2015 Xiao et al.
9,142,830 B2 9/2015 Xiao et al.
9,302,914 B2 4/2016 Liu et al.
9,577,251 B2 2/2017 Xiao et al.
9,780,361 B2 10/2017 Xiao et al.
10,062,898 B2 8/2018 Xiao
(Continued)

FOREIGN PATENT DOCUMENTS

CN 105190958 A 12/2015
CN 110062973 A 7/2019
(Continued)

OTHER PUBLICATIONS

Jeffrey David Cain et al.; U.S. Appl. No. 17/335,972, filed Jun. 1, 2021, entitled "Electrochemical Exchange For The Fabrication Of A Layered Anode Material"; 51 pages.
(Continued)

*Primary Examiner* — Zulmariam Mendez
(74) *Attorney, Agent, or Firm* — Harness, Dickey & Pierce, P.L.C.

(57) ABSTRACT

A method for extracting lithium from lithium-based materials to be recycled using an electrochemical reactor includes applying a voltage to a current collector at least partially disposed in an electrolyte carried by the electrochemical reactor, where the lithium-based materials including lithium to be recovered is disposed in the electrolyte and lithium ions move from the lithium-based material towards the current collector upon application of the voltage. In certain variations, the method may also include, prior to the application of the voltage, applying a current to the current collector.

15 Claims, 3 Drawing Sheets

(56) References Cited

U.S. PATENT DOCUMENTS

| | | | | |
|---|---|---|---|---|
| 11,011,742 | B2 | 5/2021 | Sachdev et al. | |
| 11,316,142 | B2 | 4/2022 | Jiang et al. | |
| 11,342,545 | B2 | 5/2022 | Cain et al. | |
| 11,349,119 | B2 | 5/2022 | Halalay et al. | |
| 11,978,880 | B2 | 5/2024 | Cain et al. | |
| 12,034,144 | B2 | 7/2024 | Yu et al. | |
| 2010/0173198 | A1 | 7/2010 | Zhamu et al. | |
| 2011/0244328 | A1 | 10/2011 | Iriyama et al. | |
| 2013/0146476 | A1* | 6/2013 | Chon | C22B 26/12 205/770 |
| 2014/0076734 | A1* | 3/2014 | Calvo | C25C 7/02 204/290.01 |
| 2015/0191841 | A1 | 7/2015 | Grant et al. | |
| 2016/0260967 | A1 | 9/2016 | Matus et al. | |
| 2016/0351889 | A1* | 12/2016 | Swonger | A61N 1/378 |
| 2017/0162859 | A1 | 6/2017 | Yang et al. | |
| 2018/0062153 | A1 | 3/2018 | Zhu et al. | |
| 2019/0067675 | A1 | 2/2019 | Xiao | |
| 2019/0088922 | A1 | 3/2019 | Zhamu et al. | |
| 2019/0088930 | A1 | 3/2019 | Zhamu et al. | |
| 2019/0305298 | A1 | 10/2019 | Chae et al. | |
| 2020/0119339 | A1 | 4/2020 | Halalay et al. | |
| 2020/0283921 | A1* | 9/2020 | Mislan | C25B 15/083 |
| 2020/0350558 | A1 | 11/2020 | Jimenez et al. | |
| 2020/0388825 | A1 | 12/2020 | Verbrugge et al. | |
| 2021/0013490 | A1 | 1/2021 | Lin et al. | |
| 2021/0057752 | A1 | 2/2021 | Jiang et al. | |
| 2021/0135194 | A1 | 5/2021 | Wang et al. | |
| 2021/0159500 | A1 | 5/2021 | Chae et al. | |
| 2022/0384774 | A1 | 12/2022 | Cain et al. | |
| 2023/0411610 | A1 | 12/2023 | Gu et al. | |
| 2024/0213438 | A1 | 6/2024 | Cain et al. | |
| 2024/0218544 | A1 | 7/2024 | Nagy et al. | |

FOREIGN PATENT DOCUMENTS

| | | | |
|---|---|---|---|
| CN | 112928241 | A | 6/2021 |
| CN | 118241226 | A | 6/2024 |
| CN | 118241255 | A | 6/2024 |
| DE | 102015119214 | A1 | 5/2016 |
| DE | 102020129335 | A1 | 6/2021 |
| DE | 102023120828 | A1 | 6/2024 |
| DE | 102023120834 | A1 | 6/2024 |

OTHER PUBLICATIONS

Jeffrey David Cain et al.; U.S. Appl. No. 17/335,987, filed Jun. 1, 2021, entitled "Passive Ion Exchange For The Fabrication Of A Layered Anode Material"; 42 pages.

Paul Taichiang Yu et al.; U.S. Appl. No. 17/486,378, filed Sep. 27, 2021, entitled "Solid-State Synthesis for the Fabrication of a Layered Anode Material"; 44 pages.

Yuntao Gu et al.; U.S. Appl. No. 17/840,928, filed Jun. 15, 2022, entitled "Methods for Fabricating Pre-Lithiated, Two-Dimensional Anode Materials"; 44 pages.

First Office Action for German Patent Application No. 102023120834.9 issued Feb. 19, 2026, with correspondence from Manitz Finsterwald Patent—und Rechtsanwaltspartnerschaft mbB summarizing Office Action; 5 pages.

First Office Action for German Patent Application No. 102020129335.6 issued May 12, 2025, with correspondence from Manitz Finsterwald Patent—und Rechtsanwaltspartnerschaft mbB summarizing Office Action; 6 pages.

First Office Action for Chinese Patent Application No. 202011404869.4 issued Oct. 12, 2023, with correspondence from China Patent Agent (H.K.) Ltd summarizing Office Action; 9 pages.

Non-Final Office Action issued Jul. 16, 2025, for U.S. Appl. No. 18/087,421; 22 pages.

Final Office Action issued Jan. 28, 2026, for U.S. Appl. No. 18/087,421; 25 pages.

First Office Action for German Patent Application No. 102023120828.4 issued Apr. 10, 2026, with correspondence from Manitz Finsterwald Patent—und Rechtsanwaltspartnerschaft mbB summarizing Office Action; 5 pages.

* cited by examiner

ELECTROCHEMICAL RECYCLING OF LITHIUM FROM LITHIUM-BASED MATERIALS

GOVERNMENT FUNDING

This invention was made with government support pursuant to the Department of Energy (DoE) FFRDC Argonne National Laboratory (ANL) Strategic Partnership Project (SPP) Agreement Number A21190 with General Motors LLC (GM LLC). The Government may have certain rights in the invention.

INTRODUCTION

This section provides background information related to the present disclosure which is not necessarily prior art.

Advanced energy storage devices and systems, like lithium-ion batteries, are in demand to satisfy energy and/or power requirements for a variety of products, including automotive products such as start-stop systems (e.g., 12 V start-stop systems), battery-assisted systems, hybrid electric vehicles ("HEVs"), and electric vehicles ("EVs"). To match increased demand, and various environmental concerns, it is desirable to recover usable materials from spent lithium-ion batteries. Common recycling methods including multiple chemical steps for the precipitation of positive and/or negative electroactive materials followed by further lithium extraction processes are often complicated and have poor overall recover efficiency. Accordingly, it would be desirable to develop improved apparatus and methods for extracting lithium from lithium-based materials, such as from lithium-based electroactive components of spent lithium-ion batteries.

SUMMARY

This section provides a general summary of the disclosure, and is not a comprehensive disclosure of its full scope or all of its features.

The present disclosure relates to electrochemical methods and apparatuses for extracting lithium from lithium-based materials, such as from lithium-based electroactive components of spent lithium-ion batteries and/or lithium-containing clays or ores.

In various aspects, the present disclosure provides a method for extracting lithium from lithium-based materials to be recycled using an electrochemical reactor. The method may include applying a voltage to a current collector at least partially disposed in an electrolyte carried by the electrochemical reactor, where the lithium-based materials including lithium to be recovered is disposed in the electrolyte and lithium ions move from the lithium-based material towards the current collector upon application of the voltage.

In one aspect, the voltage may be a steady voltage that is greater than or equal to about 1 mV versus $Li/Li^+$ to less than or equal to about 50 mV versus $Li/Li^+$.

In one aspect, the lithium ions may form a lithium film on one or more surfaces of the current collector.

In one aspect, the lithium film may have a thickness greater than or equal to about 1 micrometer to less than or equal to about 20 micrometers.

In one aspect, the voltage may be applied until a preselected thickness of the lithium film is achieved.

In one aspect, the voltage may be applied for a period greater than or equal to about 30 seconds to less than or equal to about 5 minutes.

In one aspect, the method may further include, prior to the application of the voltage, applying a current to the current collector.

In one aspect, the current may be a steady current greater than or equal to about 0.01 $mA/cm^2$ to less than or equal to about 0.1 $mA/cm^2$.

In one aspect, the current may be applied for a predetermined time period greater than or equal to about 30 seconds to less than or equal to about 5 minutes.

In one aspect, the current may be applied until a cell voltage reaches about 50 mV $Li/Li^+$.

In one aspect, the voltage may be applied until a cell current decays to a near zero value within about 5% of the current.

In one aspect, the electrolyte may be an electrolyte suspension that includes the lithium-based materials, and the electrolyte suspension may be prepared by contacting the electrolyte and the lithium-based materials.

In one aspect, the current collector may be a first current collector, and the electrochemical reactor may further include a second current collector. The lithium-based material may be coated on one or more surfaces of the second current collector.

In various aspects, the present disclosure provides a method for extracting lithium from lithium-based materials to be recycled using an electrochemical reactor. The method may include applying a voltage between a first current collector and a second current collector each at least partially disposed in an electrolyte in the electrochemical reactor, where the lithium-based materials including lithium to be recovered is disposed in the electrolyte and lithium ions move from the lithium-based material and plate onto the second current collector upon application of the voltage to form a lithium film.

In one aspect, the voltage may be a steady voltage greater than or equal to about 1 mV versus $Li/Li^+$ to less than or equal to about 50 mV versus $Li/Li^+$ and the voltage may be applied until a preselected thickness of the lithium film is achieved.

In one aspect, the method may further include, prior to the application of the voltage, applying a steady current between the first current collector and the second current collector. The steady current may be greater than or equal to about 0.01 $mA/cm^2$ to less than or equal to about 0.1 $mA/cm^2$.

In one aspect, the current may be applied until a cell voltage reaches about 50 mV $Li/Li^+$.

In one aspect, the electrolyte may be an electrolyte suspension that includes the lithium-based materials, and the electrolyte suspension may be prepared by contacting the electrolyte and the lithium-based materials.

In one aspect, the lithium-based material may be coated on one or more surfaces of the second current collector.

In various aspects, the present disclosure provides a method for extracting lithium from lithium-based materials to be recycled using an electrochemical reactor. The method may include applying a current greater than or equal to about 0.01 $mA/cm^2$ to less than or equal to about 0.1 $mA/cm^2$ between a first current collector and a second current collector each at least partially disposed in an electrolyte in the electrochemical reactor, wherein the lithium-based materials including lithium to be recovered is also disposed in the electrolyte; and when a cell voltage reaches about 50 mV $Li/Li^+$, applying a voltage greater than or equal to about 1 mV versus $Li/Li^+$ to less than or equal to about 50 mV versus $Li/Li^+$ between the first current collector and the second current collector, where lithium ions move from the lithium-based material and plate onto the second current collector upon application of the voltage to form a lithium film, and the voltage is applied until the lithium film has a thickness greater than or equal to about 1 micrometer to less than or equal to about 20 micrometers.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
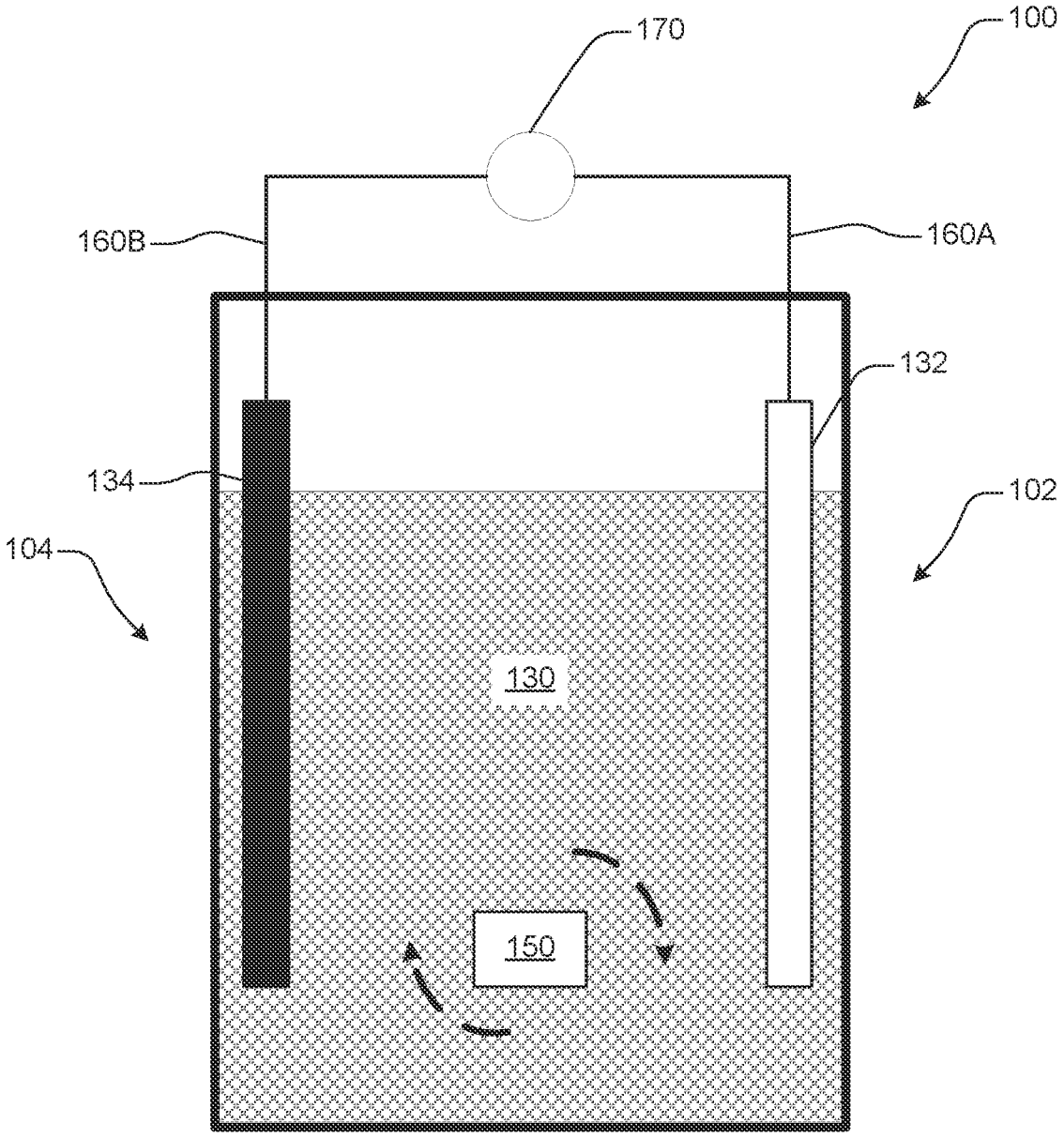
FIG. 1A is an illustration of an example electrochemical reactor for electrochemical extraction of lithium to be recovered from lithium-based materials to be recycled in accordance with various aspects of the present disclosure.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected, or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers, and/or sections should not be limited by these terms, unless otherwise indicated. These terms may be only used to distinguish one step, element, component, region, layer, or section from another step, element, component, region, layer, or section. Terms such as "first," "second," and other numerical terms when used herein do not imply a sequence or order unless clearly indicated by the context. Thus, a first step, element, component, region, layer, or section discussed below could be termed a second step, element, component, region, layer, or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

Figure 1B:
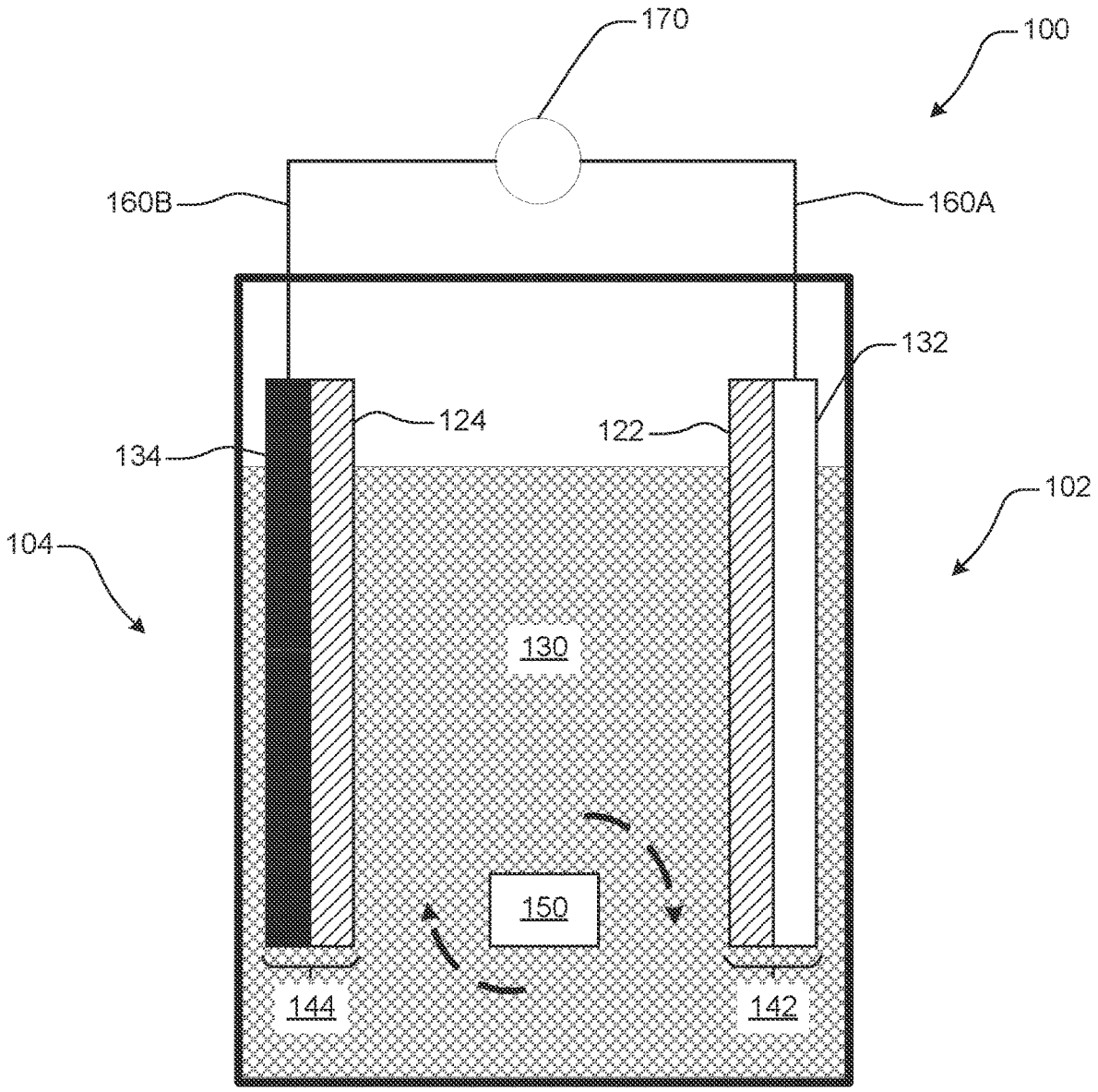
FIG. 1B is an illustration of another example electrochemical reactor for electrochemical extraction of lithium to be recovered from lithium-based materials to be recycled in accordance with various aspects of the present disclosure.

The present disclosure relates to electrochemical methods and apparatuses for extracting lithium from lithium-based materials, such as from lithium-based electroactive components of spent lithium-ion batteries and/or lithium-containing clays or ores. FIGS. 1A and 1B illustrate an example electrochemical reactor (e.g., electrochemical stir-tank) 100, which may be a batch or continuous reactor, to be used for electrochemical extraction of lithium to be recovered from lithium-based materials to be recycled.

The tank 100 may be configured to contain or carry an electrolyte 130, which may be a liquid that is continuously or intermittently replenished or replaced. The tank 100 may be a conductive vessel including one or more electrically conductive components, like electrically conductive current collectors 132, 134, disposed near or along one or more sides. For example, as illustrated, the tank 100 may include a first current collector (also referred to as a negative electrode current collector or negative current collector) 132 disposed near first side 102 of the tank 100, and a second current collector (also referred to as a positive electrode current collector or positive current collector) 134 disposed near a second side 104 of the tank 100. The first and second current collectors 132, 134 each contacts the electrolyte 130 may also be in communication using one or more lead lines 160A, 160B. For example, a first lead line 160A may connect the first current collector 132 and a load device or voltage source 170, and a second lead line 160B may connect the second current collector 134 and the load device or voltage source 170. In certain variations, the tank 100 may also include an agitator 150 configured to cause movement of the electrolyte 130. Although not illustrated, it should be appreciated that the electrochemical stir-tank 100 may include various other components as known to those skilled in the art, including, for example, a motor in communication with the agitator, an inlet, an outlet, ports, associated piping, pressure, temperature, and voltameter/ammeter monitors and control systems, and the like.

In certain variations, the one or more current collectors 132, 134 may be high-surface area current collectors, including, for example, aluminum-based or stainless-steel based current collectors, which may be in the form of porous foils, meshes, perforated foils, and/or free-standing interconnected one-dimensional structures. In other variations, the one or more current collectors 132, 134 may be high-surface area current collectors, including, for example, copper-based current collectors, carbon-based current collectors, and/or stainless-steel based current collectors, which may be in the form of porous foils, meshes, perforated foils, and/or free-standing interconnected one-dimensional structures. In still further variations, the first current collector 132 includes aluminum-based or stainless-steel based current collectors, which may be in the form of porous foils, meshes, perforated foils, and/or free-standing interconnected one-dimensional structures, while the second current collector 134 includes copper-based current collectors, carbon-based current collectors, and/or stainless-steel based current collectors, which may be in the form of porous foils, meshes, perforated foils, and/or free-standing interconnected one-dimensional structures. In each variation, the one or more current collectors 132, 134 may have surface areas (i.e., roughness factor) greater than or equal to about 1 $cm^2/(cm^2$ geometric) to less than or equal to about 10 $cm^2/(cm^2$ geometric).

The electrolyte 130 in the tank 100 may include a lithium-containing salt and an organic solvent or a mixture of organic solvents. For example, a non-limiting list of lithium salts include lithium hexafluorophosphate ($LiPF_6$), lithium perchlorate ($LiClO_4$), lithium tetrachloroaluminate ($LiAlCl_4$), lithium iodide (LiI), lithium bromide (LiBr), lithium thiocyanate (LiSCN), lithium tetrafluoroborate ($LiBF_4$), lithium tetraphenylborate ($LiB(C_6H_5)_4$), lithium bis(oxalato)borate ($LiB(C_2O_4)_2$) (LiBOB), lithium difluorooxalatoborate ($LiBF_2(C_2O_4)$), lithium hexafluoroarsenate ($LiAsF_6$), lithium trifluoromethanesulfonate ($LiCF_3SO_3$), lithium bis(trifluoromethane)sulfonylimide ($LiN(CF_3SO_2)_2$), lithium bis(fluorosulfonyl)imide ($LiN(FSO_2)_2$) (LiSFI), and combinations thereof. These and other similar lithium salts may be dissolved in a variety of non-aqueous aprotic organic solvents, including but not limited to, various alkyl carbonates, such as cyclic carbonates (e.g., ethylene carbonate (EC), propylene carbonate (PC), butylene carbonate (BC), fluoroethylene carbonate (FEC), vinylene carbonate (VC), and the like), linear carbonates (e.g., dimethyl carbonate (DMC), diethyl carbonate (DEC), ethylmethylcarbonate (EMC), and the like), aliphatic carboxylic esters (e.g., methyl formate, methyl acetate, methyl propionate, and the like), γ-lactones (e.g., γ-butyrolactone, γ-valerolactone, and the like), chain structure ethers (e.g., 1,2-dimethoxyethane, 1-2-diethoxyethane, ethoxymethoxyethane, and the like), cyclic ethers (e.g., tetrahydrofuran, 2-methyltetrahydrofuran, 1,3-dioxolane, and the like), sulfur compounds (e.g., sulfolane), and combinations thereof.

In certain variations, as illustrated in FIG. 1A, such as when the lithium-based materials to be recycled includes ores or clays, the lithium-based materials to be recycled may include an electroactive material (for example, an electroactive powder) suspended in the electrolyte 130. In other variations, as illustrated in FIG. 1B, such as when the lithium-based material to be recycled includes spent electrode assemblies, the lithium-based material to be recycled may include electroactive material layers 122, 124 disposed adjacent to one or more sides of the first current collector 132 and/or the second current collector 134. In such instances the one or more current collectors 132, 134 may be those as used in electrochemical cells and together with the as-spent electroactive material layers 122, 124 defining respective electrode assemblies 142, 144. As illustrated, a first electrode assembly 142 may include the first current collector 132 and a first electroactive material layer 122, and a second electrode assembly 144 may include the second current collector 134 and a second electroactive material layer 124. The electroactive material layers 122, 124 each contacts the electrolyte 130.

In each instance, the first current collector 132 may be positively biased and used as an anode (i.e., negative electrode) so as to extract lithium ions ($Li^+$) from the electrolyte 130 and/or the second electroactive material layer 124, and the second current collector 134 may be negatively biased and used as a cathode (i.e., positive electrode) so as to reduce lithium ions to metallic lithium forming an electroactive material layer in the first instance and/or replenishing the electroactive material layer 124 in the second instance. For example, as a current and/or voltage is applied, as detailed below, lithium ions (Li+) may move travel from the first current collector 132 to the second current collector 134 such that a non-lithium species (e.g., $Li_{(1-x)}MO_2$) may remain at the first current collector 132. In certain variations, the extraction of the lithium ions from the lithium-based material to be recycled (from the electrolyte 130 or the electroactive material layer 122) may be represented, for example, by:

$$LiMO_2 \rightarrow Li_{(1-x)}MO_2 + xLi^+ + xe^-$$

where M represents a single transition metal element or a mixture of the same and $0 \leq x \leq 1$, and the reduction of the lithium ions to metallic lithium at the positive electrode 134 may be represented, for example, by:

$$Li^+ + e^- \rightarrow Li0.$$

Figure 2:
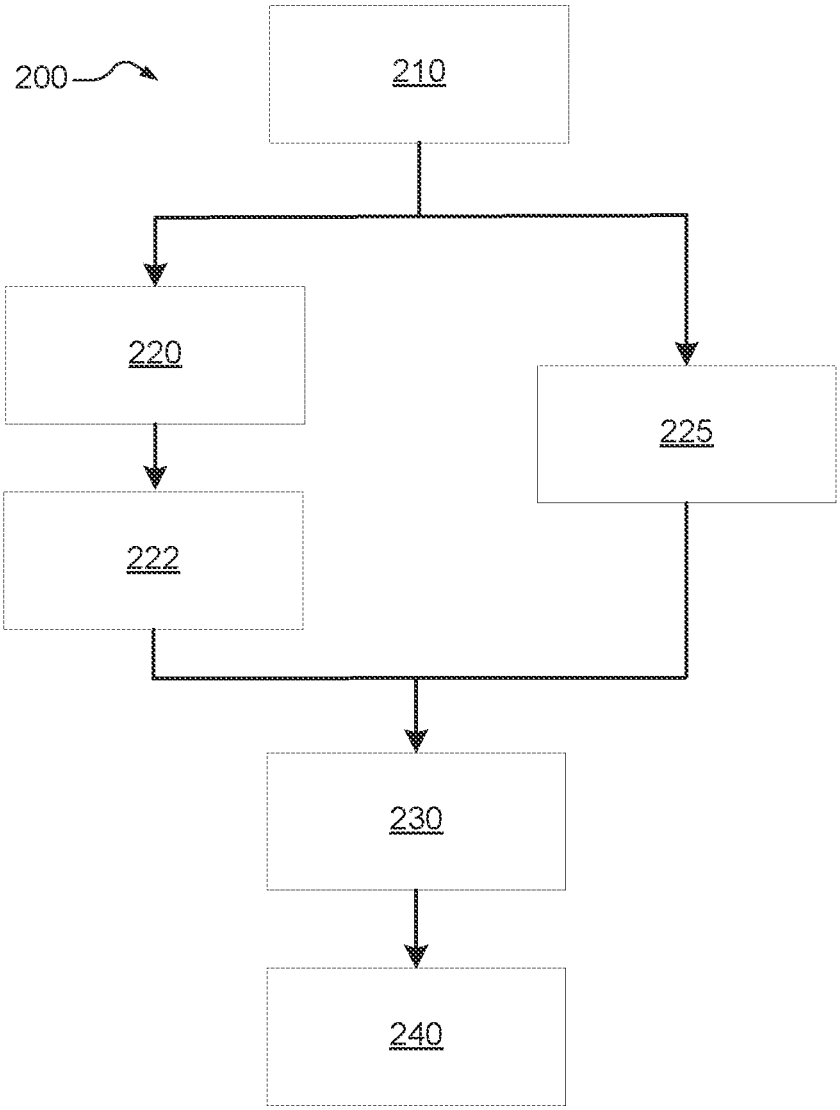
FIG. 2 is a flowchart illustrating example methods for recycling lithium-based materials using an electrochemical reactor like the electrochemical reactor illustrated in FIG. 1A and/or the electrochemical reactor illustrated in FIG. 1B in accordance with various aspects of the present disclosure.

FIG. 2 illustrates an example method 200 for extracting lithium from lithium-based materials, where the lithium-based materials may be lithium-based electroactive components of spent lithium-ion batteries and/or lithium-containing clays or ores, using an electrochemical stir-tank, like the electrochemical stir-tank 100 illustrated in FIGS. 1A and 1B. The method 200 includes contacting 210 the lithium-based materials to be recycled and the electrolyte 130. For example, in certain variations, like that illustrated in FIG. 1A, the contacting 210 may include dispersing (e.g., suspending) the lithium-based materials to be recycled in the electrolyte 130. The lithium-based materials to be recycled may be added to the electrochemical stir-tank 100 which includes the electrolyte 130, or the lithium-based materials to be recycled may be added to the electrolyte 130 prior to or as, the electrolyte 130 is introduced to the electrochemical reactor 100. The as-formed suspension may include greater than or equal to about 0.01 grams (g) of the lithium-based materials to be recycled per 1 milliliters (mL) of electrolyte 130. In other variations, like that illustrated in FIG. 1B, the contacting 210 may include at least partially disposing an as-spent electrode assembly or assemblies 142, 144 including electroactive material layers 122, 124 including the lithium-based materials to be recycled in the electrolyte 130. In each instance, the electrolyte 130 may have a temperature greater than or equal to about 5° C. to less than or equal to about 20° C., and in certain aspects, optionally greater than or equal to about 5° C. to less than or equal to about 10° C., such that the method 200 is considered a low-temperature process.

In certain variations, the method 200 may be a galvanostatic current control method that includes applying 220 a current to the second current collector 134 for a first period, and after the first period, applying 222 a voltage to the second current collector 134 or a second period, to delithiate the lithium-based materials to be recycled, so as to reduce lithium ions to metallic lithium forming an electroactive material layer in the first instance and/or replenishing the electroactive material layer 124 in the second instance. The current may be a steady current where the applied current is generally a constant current but may include minor fluctuations, including those associated with ramp up and ramp down. Similarly, the voltage may be a steady voltage where the applied voltage is generally a constant voltage but may include minor fluctuations, including those associated with ramp up and ramp down.

The applied current may be greater than or equal to about 0.01 $mA/cm^2$ to less than or equal to about 0.1 $mA/cm^2$. The reaction (dilithiation) rate may be directly proportional to the applied current. In certain variations, the first period may be a predetermined period. For example, the first period may be greater than or equal to about 30 seconds to less than or equal to about 5 minutes. In other variations, the first period may be a determinable period dependent upon an achieved cell voltage. For example, the current may be applied until the cell voltage reaches about 50 mV $Li/Li^+$. The applied voltage may be greater than or equal to about 1 mV vs. $Li/Li^+$ to less than or equal to about 50 mV vs. $Li/Li^+$. In certain variation, the second period may be dependent upon the lithiation state. For example, the second period may continue until the current decays to a near zero value (e.g., 5% of the applied current). In other variations, the second period may be a predetermined period that is dependent upon a required thickness of the lithium film at the counter electrode (i.e., the cathode). For example, in certain variations, the required thickness may be greater than or equal to about 1 micrometer (μm) to less than or equal to about 20 μm, and in certain aspects, optionally 1 μm to less than or equal to about 10 μm, and the second period may be greater than or equal to about 30 seconds to less than or equal to about 5 minutes.

In other variations, the method 200 may be a potentiostatic current control method that includes applying a voltage to the positive electrode current collector 134 for a time period. The applied voltage may be greater than or equal to about 1 mV vs. $Li/Li^+$ to less than or equal to about 50 mV vs. $Li/Li^+$. In certain variation, the time period may be dependent upon the lithiation state. For example, the time period may continue until the current decays to a near zero value (e.g., 5% of the applied current). In other variations, the time period may be a predetermined period that is dependent upon a required thickness of the lithium film at the counter electrode (i.e., cathode). For example, in certain variations, the required thickness may be greater than or equal to about 1 micrometer (μm) to less than or equal to about 20 μm, and in certain aspects, optionally 1 μm to less than or equal to about 10 μm, and the second period may be greater than or equal to about 30 seconds to less than or equal to about 5 minutes. The potentiostatic method may be used to slowly achieve the required thickness of the lithium film with smooth morphology.

In each variation, as illustrated, the method 200 may further include removing 230 the recovered lithium ions. In certain variations, the removing 230 may include using a filter to separate lithium ores after extracting the lithium content. The electrolyte 130 may be re-used for multiple extractions. In certain variations, the method 200 may also include disposing 240 the isolated lithium ions onto one or more surfaces of a negative electrode current collector to form a lithium metal anode. The isolated lithium ions may be electrodeposited onto the negative electrode current collector using a roll-to-roll process.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for extracting lithium from lithium-based materials to be recycled using an electrochemical reactor, the method comprising:

applying a current for a first period to a current collector, the first period being a first determinable period extending until a cell voltage of about 50 mV $Li/Li^+$ is achieved; and following the application of the current to the current collector, applying a voltage for a second period to the current collector at least partially disposed in an electrolyte carried by the electrochemical reactor, the electrolyte having a temperature greater than or equal to about 5° C. to less than or equal to about 20° C., the second period being a second determinable period extending until a cell current decays to a near zero value within about 5% of the current, until a preselected thickness of a lithium film formed on one or more surfaces of the current collector is achieved, or a combination thereof, and the lithium-based materials comprising lithium to be recovered is disposed in the electrolyte and lithium ions move from the lithium-based material towards the current collector upon application of the voltage.

2. The method of claim 1, wherein the voltage is a steady voltage greater than or equal to about 1 mV versus $Li/Li^+$ to less than or equal to about 50 mV versus $Li/Li^+$.

3. The method of claim 1, wherein the lithium film has a thickness greater than or equal to about 1 micrometer to less than or equal to about 20 micrometers.

4. The method of claim 1, wherein the second period is greater than or equal to about 30 seconds to less than or equal to about 5 minutes.

5. The method of claim 1, wherein the current is a steady current greater than or equal to about 0.01 $mA/cm^2$ to less than or equal to about 0.1 $mA/cm^2$.

6. The method of claim 1, wherein the first period is greater than or equal to about 30 seconds to less than or equal to about 5 minutes.

7. The method of claim 1, wherein the electrolyte is an electrolyte suspension comprising the lithium-based materials, and the electrolyte suspension is prepared by contacting the electrolyte and the lithium-based materials.

8. The method of claim 1, wherein the current collector is a first current collector, and the electrochemical reactor further comprises a second current collector, and the lithium-based material is coated on one or more surfaces of the second current collector.

9. A method for extracting lithium from lithium-based materials to be recycled using an electrochemical reactor, the method comprising:

applying a current first a first period between a first current collector and a second current collector, the first period being a first determinable period extending until a cell voltage of about 50 mV $Li/Li^+$ is achieved; and following the application of the current between the first current collector and the second current collector, applying a voltage for a second period between the first current collector and the second current collector each at least partially disposed in an electrolyte in the electrochemical reactor, the electrolyte having a temperature greater than or equal to about 5° C. to less than or equal to about 20° C., the second period being a second determinable period extending until a cell current decays to a near zero value within about 5% of the current, until a preselected thickness of a lithium film formed on one or more surfaces of the current collector is achieved, or a combination thereof, and the lithium-based materials comprising lithium to be recovered is disposed in the electrolyte and lithium ions move from the lithium-based material and plate onto the second current collector upon application of the voltage to form a lithium film.

10. The method of claim 9, wherein the voltage is a steady voltage greater than or equal to about 1 mV versus $Li/Li^+$ to less than or equal to about 50 mV versus $Li/Li^+$.

11. The method of claim 10, wherein the current is a steady current greater than or equal to about 0.01 $mA/cm^2$ to less than or equal to about 0.1 $mA/cm^2$ between the first current collector and the second current collector.

12. The method of claim 11, wherein the current is applied until a cell voltage reaches about 50 mV $Li/Li^+$.

13. The method of claim 10, wherein the electrolyte is an electrolyte suspension comprising the lithium-based materials, and the electrolyte suspension is prepared by contacting the electrolyte and the lithium-based materials.

14. The method of claim 10, wherein lithium-based material is coated on one or more surfaces of the second current collector.

15. A method for extracting lithium from lithium-based materials to be recycled using an electrochemical reactor, the method comprising:

applying a current greater than or equal to about 0.01 $mA/cm^2$ to less than or equal to about 0.1 $mA/cm^2$ for a first period between a first current collector and a second current collector each at least partially disposed in an electrolyte in the electrochemical reactor, the first period being a first determinable period extending until a cell voltage of about 50 mV $Li/Li^+$ is achieved, the electrolyte having a temperature greater than or equal to about 5° C. to less than or equal to about 20° C., the lithium-based materials comprising lithium to be recovered is also disposed in the electrolyte; and following the application of the current to the current collector, applying a voltage greater than or equal to about 1 mV versus $Li/Li^+$ to less than or equal to about 50 mV versus $Li/Li^+$ for a second period between the first current collector and the second current collector, lithium ions move from the lithium-based material and plate onto the second current collector upon application of the voltage to form a lithium film, the second period being a second determinable period extending until the lithium film has a thickness greater than or equal to about 1 micrometer to less than or equal to about 20 micrometers.

* * * * *